United States Patent [19]

Daborowski et al.

[11] 4,160,434

[45] Jul. 10, 1979

[54] EXCESS FUEL STARTING DEVICE FOR FUEL INJECTION ENGINES

[75] Inventors: Ignace J. Daborowski, Springfield; Leon A. Galis, Ludlow, both of Mass.

[73] Assignee: Ambac Industries, Inc., Springfield, Mass.

[21] Appl. No.: 870,761

[22] Filed: Jan. 19, 1978

[51] Int. Cl.[2] ..... F02D 1/04; F02D 1/06; F02M 39/00

[52] U.S. Cl. ..... 123/140 FG; 123/179 L; 123/179 G; 123/139 ST

[58] Field of Search ..... 123/140 FG, 140 R, 179 L, 123/179 G, 139 ST, 140 FP

[56] References Cited

U.S. PATENT DOCUMENTS

| | | | |
|---|---|---|---|
| 3,311,101 | 3/1967 | Huse | 123/139 R |
| 3,311,102 | 3/1967 | Voigt | 123/179 L |
| 3,707,144 | 12/1972 | Galis et al. | 123/179 L |
| 3,960,127 | 6/1976 | Vuaille | 123/140 FG |

*Primary Examiner*—Charles J. Myhre
*Assistant Examiner*—M. Moy
*Attorney, Agent, or Firm*—Richard D. Weber

[57] ABSTRACT

An excess fuel starting device for a fuel injection engine having a full load stop coacting with the engine throttle linkage to limit the fuel input from the fuel injection pump to the engine. A hydraulic actuator positions the full load stop in either a normal run position or an excess fuel position. The actuator includes a cylinder containing an excess fuel piston operatively connected to the full load stop and spring biased toward an excess fuel position. A coaxial bore within the excess fuel piston contains a free piston slidable therewithin. Fluid conduit means is provided for delivering a fluid pressurized during engine operation to actuate only the smaller free piston when the actuator is in the excess fuel position. When the excess fuel piston has been moved by the action of the free piston to the normal run position, the fluid conduit means delivers the pressurized fluid to provide a holding force against the larger excess fuel piston. The differential in the actuating pressure versus the holding pressure of the device may be varied to suit the installation requirements by the choice of the relative diameters of the excess fuel and inner pistons.

4 Claims, 6 Drawing Figures

EXCESS FUEL STARTING DEVICE FOR FUEL INJECTION ENGINES

BACKGROUND OF THE INVENTION

The present invention relates to a hydraulically actuated starting device for fuel injection engines which automatically permits an excess fuel delivery during cranking of the engine.

To facilitate the starting of a fuel injection engine, it is desirable during cranking to provide a fuel delivery in excess of the normal full load delivery. Since the fuel delivery is generally limited by a full load stop coacting with the engine throttle linkage, it is necessary, in order to permit an excess fuel injection, to provide a mechanism which changes the position of the full load stop during the engine cranking period.

In U.S. Pat. Nos. 3,311,101, 3,311,102, and 3,707,144, each of which is assigned with the present invention to a common assignee, hydraulically actuated starting devices are disclosed which automatically position the full load stop to permit excess fuel delivery during the engine cranking period. Although these devices have worked satisfactorily to accomplish their intended purpose, due to the nature of their construction it has been necessary to design and manufacture a different starting device having the desired operating characteristics for each engine model. In particular, it was not heretofore possible to readily vary the differential in the actuating and holding forces developed by the fluid pressurized upon starting of the engine. In the present invention, the ratio of the actuating and holding forces may be selected as required by a simple dimensional change in the device.

SUMMARY OF THE INVENTION

The present starting device in brief comprises a hydraulic actuator operatively connected to the engine governor full load stop for movement thereof between a normal operating full load position and an excess fuel starting position. The actuator comprises a housing having a cylindrical bore therein with an excess fuel piston slidably disposed within the bore and forming a first chamber at one end thereof. Means are provided for adjustably connecting the full load stop plate with the excess fuel piston, and a spring serves to bias the excess fuel piston and the full load stop toward an excess fuel position.

A coaxial bore is provided within the excess fuel piston opening into the first chamber and containing a free piston slidably disposed therewithin and forming a second chamber within the coaxial bore. A fluid inlet port in the housing opens into the housing bore and is connected with a source of fluid pressurized during running of the engine. Fluid passage means are provided in the excess fuel piston which connects the fluid inlet port with the second chamber when the excess fuel piston is in the excess fuel position to thereby pressurize the second chamber and move the excess fuel piston and full load stop into a normal operating full load position upon engine starting. In the normal operating position, the fluid inlet port opens into the first chamber so that the pressurized fluid acts against the entire excess fuel piston to provide a holding force while the engine is running. A vent port in the housing bore communicates with suitable passage means in the excess fuel piston to vent the first chamber when the excess fuel piston is in the excess fuel position, and to vent the second chamber when the excess fuel piston is in the normal operating position.

In order to provide the desired differential between the actuating and holding pressures, the dimension of the coaxial free piston bore is selected in the proper proportion to the diameter of the housing bore and the excess fuel piston. Accordingly, the only design change required to vary the actuating pressure relative to the holding pressure is in the dimension of the coaxial excess fuel piston bore and the diameter of the free piston slidable therewithin.

In view of the above, it is a primary object of the present invention to provide a fully automatic fuel injection engine starting device permitting fuel delivery in excess of the normal full load delivery during cranking to facilitate engine starting.

A further object of the invention is to provide a device as described which automatically reduces the permissible maximum fuel delivery to the normal full load fuel limit after the engine starts to prevent over fueling.

Another object of the invention is to provide a device as described which permits an excess fuel delivery for a sufficient time during the engine starting period to assure adequate fuel delivery while the engine is cold and to prevent stalling of the engine in the event of a momentary misfire.

Still another object of the invention is to provide a device as described which upon engine stoppage is automatically reset to permit the desired excess fuel condition for a subsequent start.

Still another object of the invention is to provide an excess fuel device as described which can be easily modified to suit the requirements of different engine designs.

Additional objects and advantages of the invention will be more readily apparent from the following description of an embodiment thereof when taken together with the accompanying drawings.

DESCRIPTION OF THE PREFERRED EMBODIMENT

Figure 1:
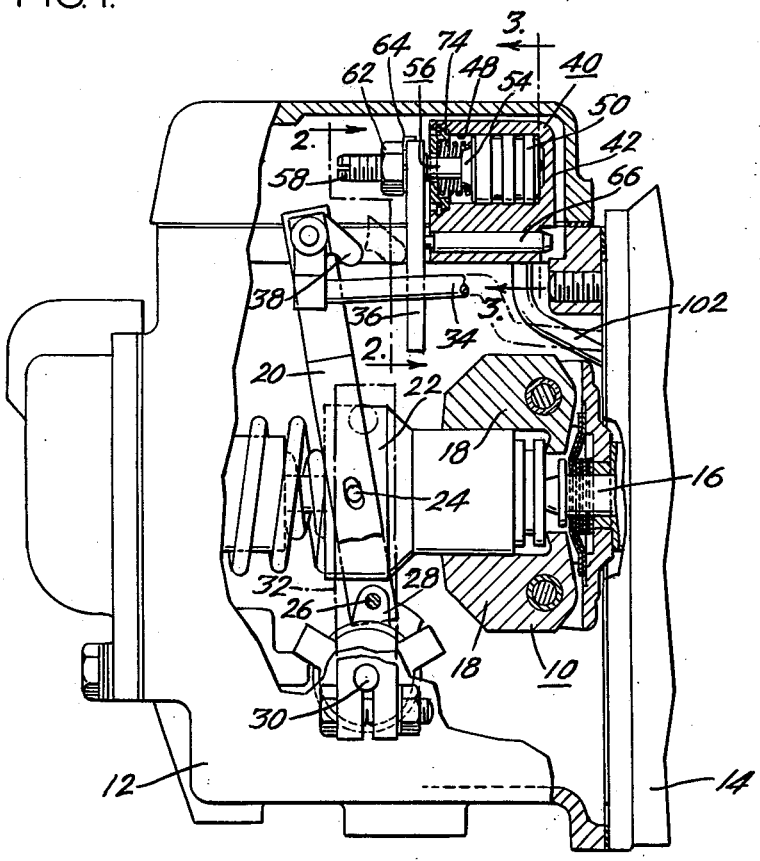
FIG. 1 is a cutaway view partly in section of a fuel injection engine governor having an excess fuel device in accordance with the present invention.

Referring to the drawings and particularly FIG. 1 thereof, the illustrated embodiment of the present starting device is shown in conjunction with a fuel injection engine governor 10 enclosed within a governor housing 12 mounted adjacent a partly shown fuel injection pump 14. The governor 10 in brief includes a governor shaft 16 driven by the fuel injection pump cam shaft (not shown). Centrifugal weights 18 are pivotally mounted on the governor shaft 16 and govern the position of a fulcrum lever 20 acting through a spring loaded linkage 22 connected to the fulcrum lever by pin 24. The lower end of the fulcrum lever is secured by pin connection 26 to trunion lever 28 on operating lever shaft 30, the operating lever being shown in broken lines at 32.

Pivotally connected with the upper end of the fulcrum lever 20 is the fuel control rod 34, the movement of which controls the fuel output of the fuel injection pump. The movement of the control rod 34 to the right provides an increased fuel output of the pump and conversely movement to the left provides a decreased pump fuel output. The pump fuel output is limited by a vertical full load stop plate 36 which is positioned to limit the movement of the upper end of fulcrum lever 20 by contact with the cam 38 thereon. Although the governor full load stop in some engines is fixed or manually adjustable, the present invention provides an arrangement whereby the full load stop is automatically repositioned to provide an excess fuel delivery during the cranking of the engine.

Figure 2:
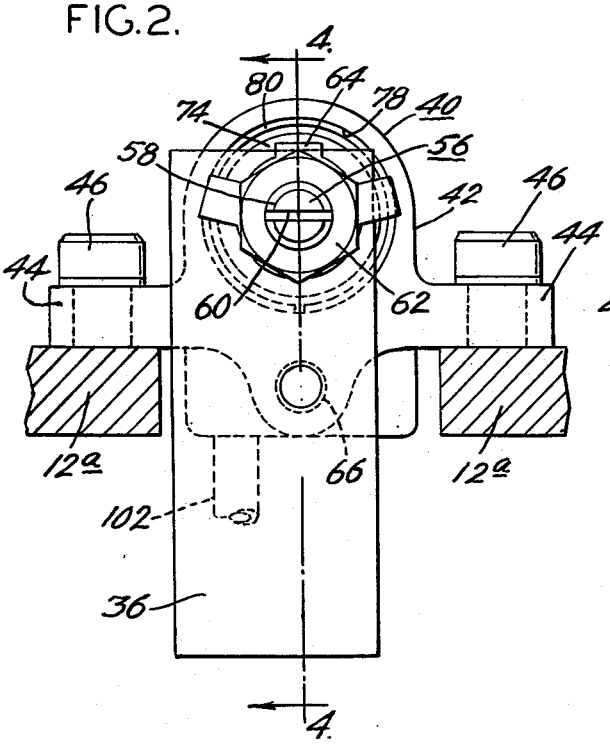
FIG. 2 is an enlarged sectional view taken along line 2—2 of FIG. 1.
Figure 3:
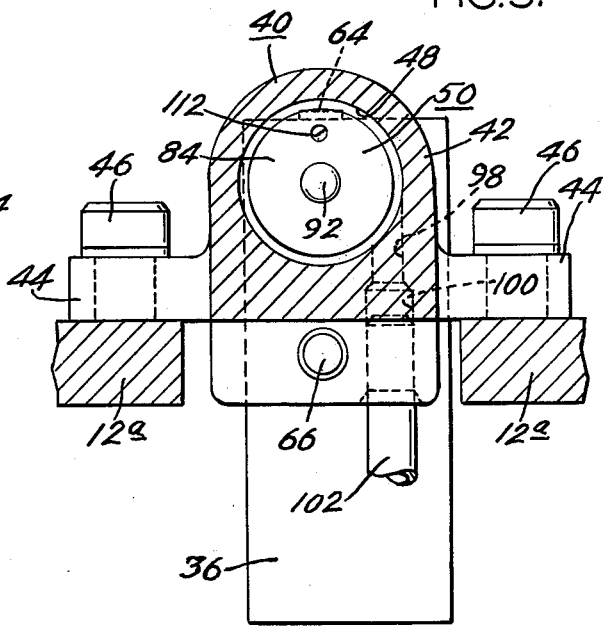
FIG. 3 is an enlarged sectional view taken along line 3—3 of FIG. 1.

The present excess fuel device comprises a hydraulic actuator 40 operatively connected to the full load stop 36 for movement thereof from a normal operating full load position (FIG. 5) to an excess fuel starting position (FIGS. 1 and 4) upon engine stoppage. With reference to FIGS. 2–6, the actuator 40 comprises a housing 42 having side flanges 44 secured to portions 12*a* of governor housing 12 by screws 46 as shown in FIGS. 2 and 3. The housing 42 includes a cylindrical bore 48 opening toward the full load stop and containing an excess fuel piston 50 slidably disposed therewithin. The outer end of the piston 50 facing the stop plate 36 includes a concentric circular groove 52 therein within which is seated the cup-shaped end 54 of a stop plate screw 56. The stop plate screw 56 includes a threaded outer portion 58 having an adjusting slot 60 at its outer end. The screw 56 passes through a threaded bore in the upper end of the stop plate 36 and the relative position of the cup-shaped end 54 of the screw 56 with respect to the stop plate is adjusted by rotation of the screw by means of a screwdriver engaged in the slot 60. A nut 62 and a tab washer 64 lock the screw 56 in the desired position with respect to the stop plate 36. A guide pin 66 secured to the stop plate 36 is slidably disposed within a bore 68 in the housing 42 parallel with the bore 48 to maintain the proper alignment of the stop plate.

Figure 4:
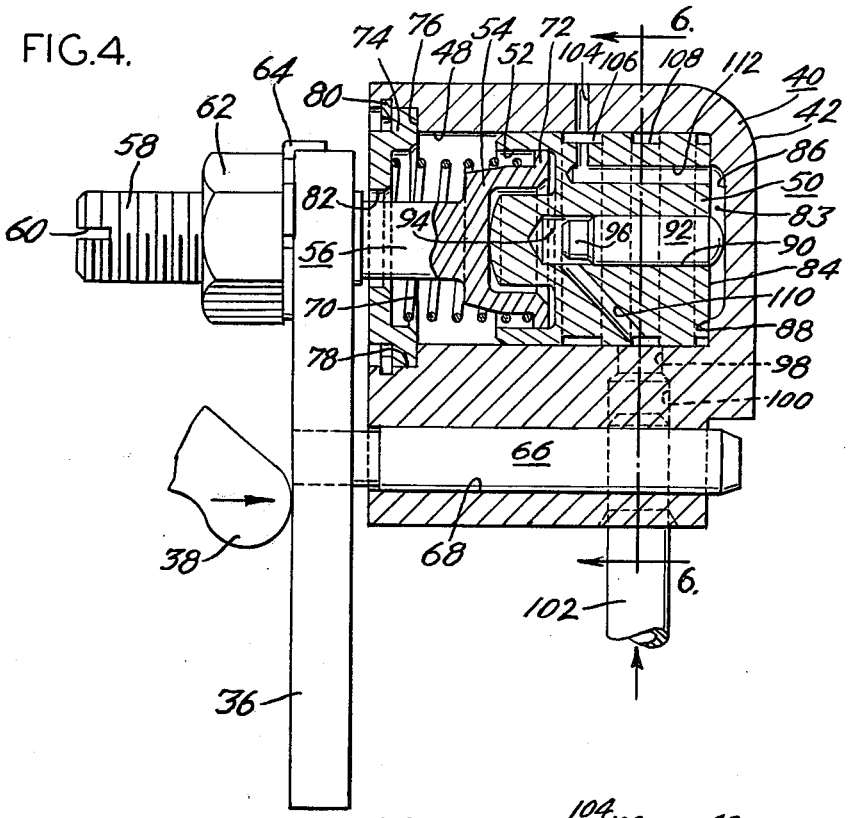
FIG. 4 is an enlarged sectional view taken along line 4—4 of FIG. 2 showing details of the excess fuel device with the full load stop in the excess fuel position.

The excess fuel piston 50, stop plate screw 56 and the attached stop plate 36 are biased toward the excess fuel position shown in FIG. 4 by a compression coil spring 70 disposed around the cup-shaped end 54 of the screw 56 and engaging a flange portion 72 thereof. At its outer end, the spring 70 bears against a stop disc 74 which is seated on a shoulder 76 formed by counterbore 78 in the housing 42 coaxial with the bore 48. The stop disc 74 is held in position by a retaining ring 80. A coaxial bore 82 in the stop disc 74 permits free passage of the stop plate screw 56 therethrough.

A chamber 83 is formed between the inner end 84 of the excess fuel piston and the end 86 of the bore 48. The inward travel of the excess fuel piston is arrested by an annular shoulder 88 adjacent the bore end. The force of the spring 70 serves to hold the stop plate screw 56 in continuous engagement with the excess fuel piston 50 in all positions of the piston. The position of the piston 50 will accordingly determine the position of the stop plate 36 attached to the stop plate screw 56.

Figure 5:
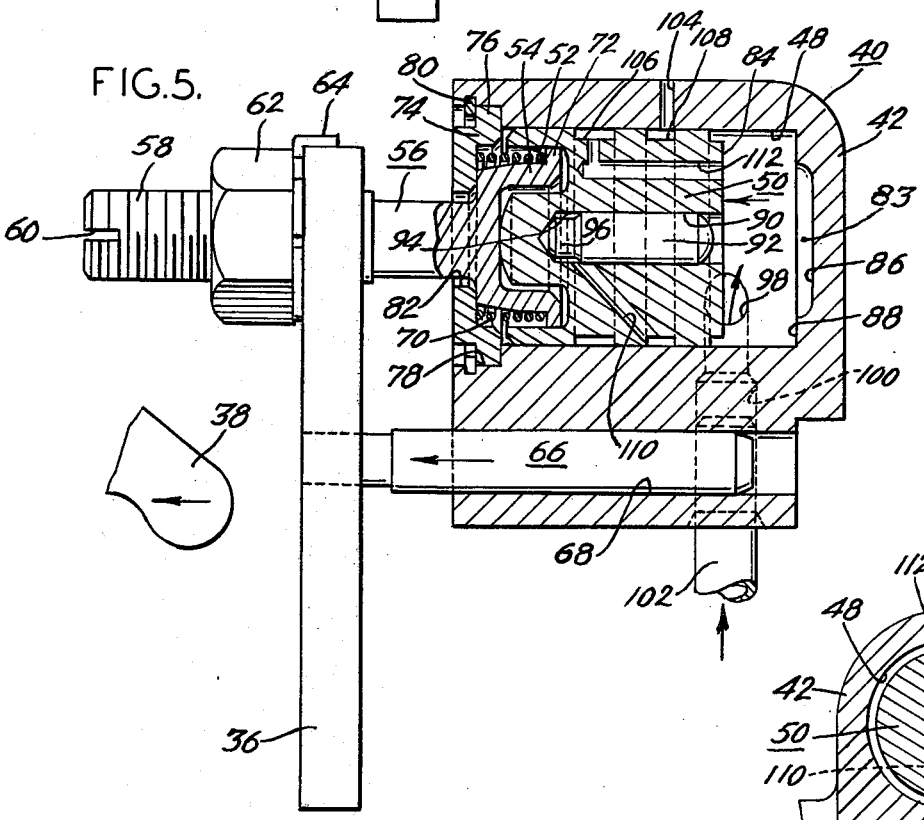
FIG. 5 is a view similar to FIG. 4 with the full load stop in the normal run position.
Figure 6:
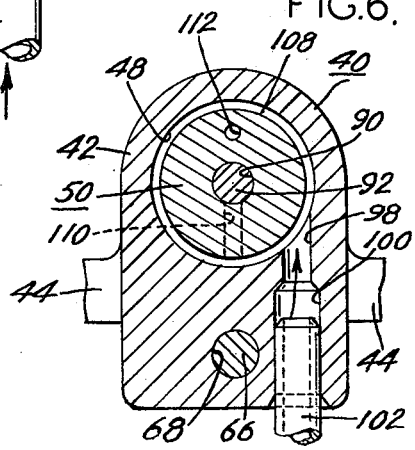
FIG. 6 is a reduced sectional view taken along line 6—6 of FIG. 4.

The excess fuel position 50 includes a coaxial bore 90 extending partway therethrough from the inner end 84 thereof. A free piston 92 having a length slightly shorter than that of the bore 90 is freely slidable within the bore 90. The free piston 92 in cooperation with the bore 90 form a chamber 94 within the excess fuel piston 50. The end of the free piston 92 is necked down at 96 so that the chamber 94 still exists even when the free piston 92 is against the end of the bore 90 as shown in FIG. 5.

Means are provided for introducing a pressurized fluid into the bore 48, said fluid being pressurized only during the running of the engine supplied with fuel by pump 14. This means comprises a port 98 (FIGS. 5 and 6) in the bore 48 connecting the bore with a fluid passage 100 in the housing 42. An enlarged portion of the passage 100 receives a fluid conduit 102 secured therewithin and which is connected with a source of fluid pressurized only during the running of the engine. In the preferred embodiment, the pressurized fluid is the engine lubricating oil pressurized by the engine oil pump.

A vent port 104 in the housing 42 axially displaced from the port 98 connects the bore 48 with the interior of the governor housing 12.

Conduit means are provided in the excess fuel piston 50 for the purpose of introducing pressurized fluid from the port 98 into the chamber 94 and simultaneously connecting the chamber 83 with the vent port 104 when the piston 50 is in the excess fuel starting position shown in FIG. 4. The conduit means serves when the piston 50 is in the position shown in FIG. 5 to connect the chamber 94 with the vent port 104 while introducing the pressurized fluid into chamber 83. The conduit means in the piston 50 for carrying out these functions comprises a pair of axially spaced annular grooves 106 and 108. The groove 108 is so located as to communicate with the port 98 when the piston 50 is in the excess fuel position of FIG. 4 and to communicate with the vent port 104 when the piston 50 is in the normal run position of FIG. 5. The groove 106 is so positioned as to communicate with the vent port 104 when the piston 50 is in the excess fuel position shown in FIG. 4. The conduit means of the piston 50 further includes a diagonal passage 110 extending between the groove 108 and the chamber 94, as well as a passage 112 extending from the groove 106 to the inner end 84 of the excess fuel piston.

In operation, with the engine stopped the fluid delivered by the conduit 102 and port 98 will no longer be pressurized and the chambers 83 and 94 will drop to the ambient governor housing pressure due to fluid leakage along the excess fuel piston 50 and the free piston 92 to the vent port 104. The combined forces of the governor linkage (acting through cam 38) and the spring 70 will accordingly automatically reset the excess fuel piston and full load stop to the excess fuel position to FIG. 4 upon engine stoppage.

When the engine is started, the pressurized fluid passes from conduit 102 through inlet port 98 into annular groove 108, passage 110 and chamber 94. The pressurization of chamber 94 moves the free piston 92 into engagement with the end 86 of housing bore 48. When the pressure in chamber 94 becomes sufficiently high to overcome the opposing forces of the cam 38 and spring 70, the excess fuel piston 50, stop plate screw 56 and full load stop plate 36 are moved into the normal operating position of FIG. 5, the stop disc 74 limiting the travel of the screw 56. In this position, the inlet port 98 opens directly into the first chamber 82, providing a pressurization of the chamber and a holding force which is substantially longer than the actuating force developed by the pressurization of the second chamber 94. The vent port 104 is aligned with groove 108 in the normal operating position and through passage 110 serves to vent the second chamber 94 to the ambient pressure. Leakage around the free piston can thus be removed, allowing the excess fuel piston to reset upon engine stoppage as described above. The groove 106 is blocked by the housing bore 48 in the operating position of FIG. 5.

The employment of a smaller actuating force to initiate the movement of the excess fuel piston than that provided to hold the piston in the operating position results in a desirable delay in shifting from the excess fuel position to prevent engine stalling while cold or due to a momentary misfire. The relative actuating and holding pressures are chosen to suit the engine characteristics and can readily be varied in the present device by varying the diameters of the bore 90 and free piston 92.

Manifestly, changes in details of construction can be effected by those skilled in the art without departing from the spirit and scope of the invention.

We claim:

1. An excess fuel starting device for a fuel injection engine having a full load stop coacting with the engine throttle linkage to limit the fuel input thereto comprising, a hydraulic actuator operatively connected to the full load stop for movement thereof between a normal operating full load postiion and an excess fuel starting position, said actuator comprising a housing having a cylindrical bore therein, an excess fuel piston slidably disposed within said bore and forming a first chamber at one end thereof, means operatively connecting the full load stop plate with said excess fuel piston, spring means urging said excess fuel piston and stop plate into an excess fuel position, a coaxial bore within said excess fuel piston opening into said first chamber, a free piston slidably disposed within said coaxial bore and forming a second chamber at one end thereof, a fluid inlet port in said housing opening into said housing bore, conduit means connecting said fluid inlet port with a source of fluid pressurized during running of the engine, fluid passage means in said excess fuel piston connecting said fluid inlet port with said second chamber when said excess fuel piston is in the excess fuel position to thereby upon engine starting pressurize said second chamber, move said free piston against the end of said housing bore and move said excess fuel piston and full load stop into a normal operating full load position, said fluid inlet port opening into said first chamber in the normal operating full load position of said excess fuel piston to pressurize said chamber and provide a holding force acting against said excess fuel piston while the engine is running.

2. The invention as claimed in claim 1 wherein said means operatively connecting the full load stop plate with said excess fuel piston comprises a stop plate screw adjustably connected to the full load stop plate.

3. The invention as claimed in claim 1 wherein said housing includes a vent port passing therethrough and communicating with said housing bore, and fluid passage means in said excess fuel piston connecting said vent port with said first chamber when said excess fuel piston is in the excess fuel position and connecting said vent port with said second chamber when the excess fuel piston is in the normal operating full load position.

4. The invention as claimed in claim 3 wherein said excess fuel piston fluid passage means comprises a pair of axially spaced annular grooves in said piston, a first one of said grooves communicating with said fluid inlet port when said excess fuel piston is in the excess fuel position, a fluid passage extending between said first one of said grooves and said second chamber, the other one of said grooves communicating with said vent port when said excess fuel piston is in the excess fuel position, and a fluid passage extending between said other one of said grooves and said first chamber.

* * * * *